United States Patent [19]

Barrette

[11] 4,422,217

[45] Dec. 27, 1983

[54] PACKAGING FASTENER

[76] Inventor: Richard P. Barrette, 8 Lee St., South Lancaster, Mass. 01523

[21] Appl. No.: 280,116

[22] Filed: Jul. 2, 1981

[51] Int. Cl.[3] ..... B65D 63/00; B65D 67/02

[52] U.S. Cl. ..... 24/16 R; 24/16 PB; 248/74 PB

[58] Field of Search ..... 24/16 PB, 20 EE, 115 R, 24/16 R; 248/74 PB; 292/318

[56] References Cited

U.S. PATENT DOCUMENTS

| | | | |
|---|---|---|---|
| 3,457,598 | 7/1969 | Mariani | 24/16 PB |
| 3,530,544 | 9/1970 | Burniston | 24/16 PB |
| 3,542,321 | 11/1970 | Kahabka | 248/74 PB |
| 3,562,870 | 2/1971 | Sund | 24/16 PB |
| 3,588,961 | 6/1971 | Farago | 24/16 PB |
| 3,632,070 | 1/1972 | Thayer | 248/74 PB |
| 3,667,710 | 6/1972 | Moody et al. | 248/74 PB |
| 3,721,750 | 3/1973 | Countryman | 24/16 PB |
| 3,739,429 | 6/1973 | Kohke | 24/16 PB |
| 3,875,618 | 4/1975 | Schuplin | 24/16 PB |
| 3,966,247 | 6/1976 | Muller, Jr. et al. | 292/318 |

*Primary Examiner*—John J. Wilson

*Attorney, Agent, or Firm*—E. Thorpe Barrett

[57] ABSTRACT

A fastener for bundling wires or packaging other articles in which the ends of a smooth flexible plastic strap are inserted into parallel passageways through a plastic body and retained by locking ears extending into the passageways. An anchor member, formed from a single piece of spring sheet metal, includes a base portion, the two oppositely-extending locking ears and two intermediate oppositely-extending retaining ears that retain the anchor member within the body. The locking ears extend into the passageways to cinch the strap and prevent its being withdrawn. The outer ends of the locking ears are beveled to improve the holding power of the head. When the fastener has been applied to tie a bundle of articles, the forces operating on the fastener are in directions transverse to the axes of the passageways, thereby substantially increasing the holding power of the fastener. In another embodiment, only one passageway extends completely through the body, the other passageway being closed at one end and permanently retaining therein one end of a pre-cut plastic strap. The anchor member fastener is formed from a continuous sheet metal strip by a progressive die that forms and inserts the anchor member into the head where it is retained by the outward flexing of the retaining ears. Means are provided for releasing and re-using the fastener.

4 Claims, 15 Drawing Figures

PACKAGING FASTENER

BACKGROUND OF THE INVENTION

1. Field of the Invention

This invention relates to self-locking packaging fasteners for bundling electrical cables or securing other parts or packages. A flexible strap is placed around the objects to be bundled and is held under tension by a fastener that anchors each end of the strap.

2. Description of the Prior Art

Many kinds of ties have been proposed and are widely used to tie bundles of connectors. Many of these have a head formed integrally with one end of the strap. Such one piece cable ties are illustrated by U.S. Pat. Nos. 3,739,430 to Kohke; 3,872,547 to Caveney et al; and 3,484,905 to Eberhardt. Other cable ties have a separate head that anchors each end of the strap, permitting the use of a long length of strap material that can be cut to the appropriate length for each use. Some of these fasteners require the use of a strap having indexing means for securing the strap to the head and are therefore adjustable only in finite steps. The use of vanes extending at an angle from the strap and which overlap to anchor them within the head is shown by U.S. Pat. No. 3,694,863 to Wasserlien. Straps having ratchet teeth or surfaces for securing purposes are illustrated by U.S. Pat. Nos. 3,197,829 to Caveney; 3,258,819 and 3,909,884 to Weckesser; 3,816,878 to Fulton et al; 3,653,099 to Hoffman; 3,747,164 to Fortsch; and 3,744,096 to Kok. Other kinds of ties depend upon the strength of a metal spring pawl impinging upon the surface of the strap to bear directly the entire tension load of the strap. Such a fastener is illustrated by U.S. Pat. Nos. 3,397,430 to Pearl; 3,192,584 to Pape; and 3,488,813 to Kohke.

SUMMARY OF THE INVENTION

Applicant's invention overcomes many of the disadvantages of the earlier devices. A separate body permits use of continuous length strap material that need have no ratchet teeth or serrations and thus avoids wasted material and permits infinite adjustment of the strap. Two metal locking ears within the body each anchor one end of the strap and are arranged so that the tension load of the strap is carried in large part by the plastic body structure rather than by the metal locking ears. These and other advantages of applicant's invention will be in part pointed out in and in part apparent from the following description of a preferred embodiment of the invention considered together with the accompanying drawing.

DESCRIPTION OF PREFERRED EMBODIMENTS OF THE INVENTION

In use, one end of a length of a tie strap 2, which may be formed of nylon or other suitable material, is inserted into a passageway 4 (FIGS. 1 and 5–8) in the body 10 of a fastener, generally indicated at 6, and is secured by a metal anchor member 8. The strap 2 is then wrapped around the bundle to be secured and inserted into a second passageway **4*a* where it is secured by the same anchor member 8**.

Figure 2:
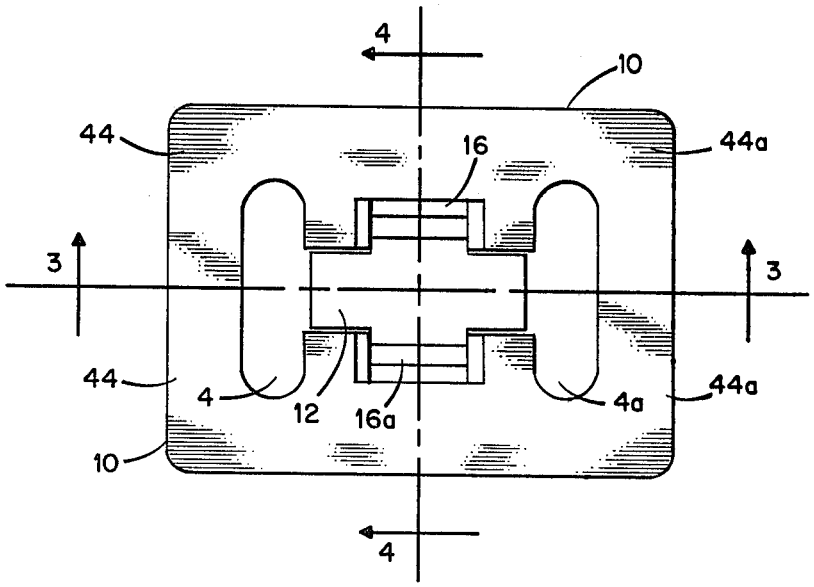
FIG. 2 is a plan view of the body of the fastener before the insertion of the metal anchor member.
Figure 3:
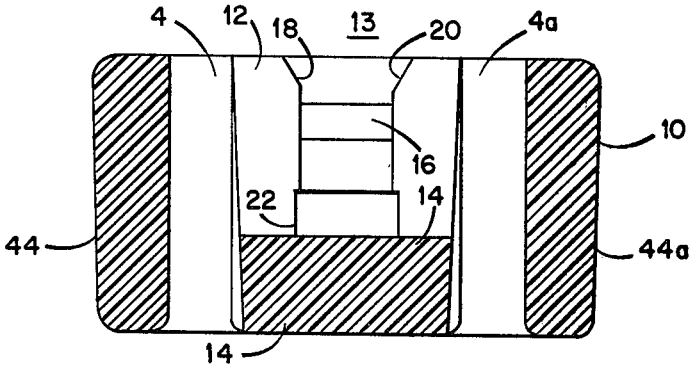
FIG. 3 is a section along line 3—3 of FIG. 2.
Figure 4:
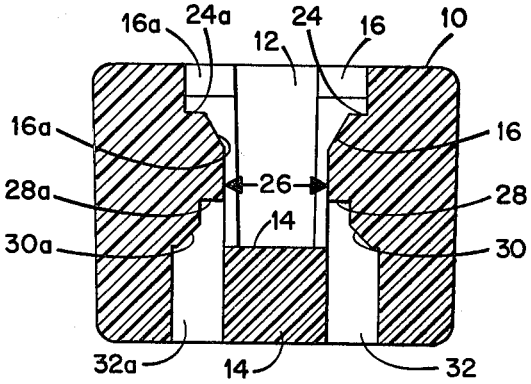
FIG. 4 is a section along line 4—4 of FIG. 2.
Figure 5:
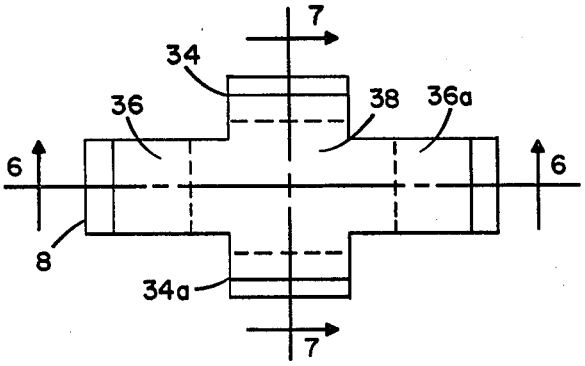
FIG. 5 is a plan view of the metal anchor member before being placed in the body shown in FIG. 2.

The construction of the body 10, which is preferably molded from a high strength plastic such s nylon, is illustrated by FIGS. 2–4 and comprises a single-piece plastic body, preferably molded of nylon or other high strength plastic. The two spaced parallel passageways 4 and **4*a*, which are shaped with rounded end surfaces to conform to the cross-sectional shape of the tie strap 2, extend through the body for reception of opposite ends of the strap 2. A transverse chamber 12, which is open at the end indicated at 13 in FIG. 3, referred to herein for convenience at the top or upper end of the body 10 or fastener 6, extends between the two passageways 4 and 4*a* and provides space for the anchor member 8. The lower end of the chamber 12 is formed by a floor 14, an integral part of the body 10, against which the anchor member 8 will be seated upon assembly. Each of the opposing side walls of the chamber 12 has a vertical groove, as shown at 16 and 16*a*, that extends the full length of the chamber. In the section shown in FIG. 3, the entrance to the groove 16 is provided with opposing tapered entrance ways 18 and 20 that form angles of about 30 degrees from the longitudinal axis of the groove. The sidewalls of the groove 16 adjacent the tapered entrance ways are linear. The opposing groove 16*a*** is of similar shape.

The shapes of the rear surfaces of the grooves 16 and **16*a* are shown in FIG. 4. A short distance below its upper end, the rear surface of the groove 16, is reduced in width to form a shelf 24 from which point the surface is tapered inwardly, at an angle of about 30°, until it reaches the minimum groove width as indicated by dimension 26. At a point below this section of minimum width, the width of the rear surface of the groove abruptly increases to form a retaining shoulder 28 that serves to lock the anchor member 8 in place. The rear surface of the groove 16, near its lower end, is widened by a chamfer 30 that leads into a slot 32 that extends to the bottom end of the body. The rear surface of the opposite groove 16*a* is similarly contoured to form a shelf 24*a*, a retaining shoulder 28*a*, and a chamfer 30*a* that leads to a similar slot 32*a***.

Figure 6:
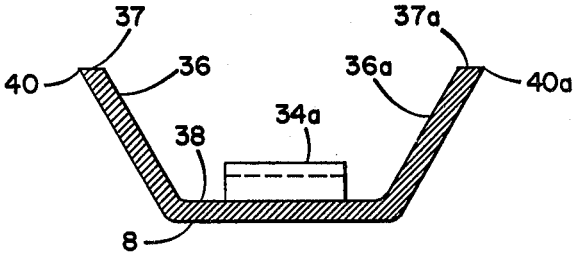
FIG. 6 is a section along line 6—6 of FIG. 5.
Figure 7:
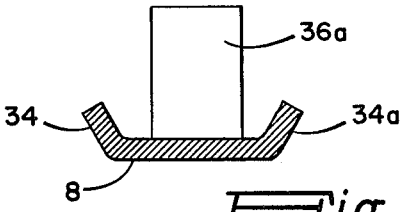
FIG. 7 is a section along line 7—7 of FIG. 5.
Figure 8:
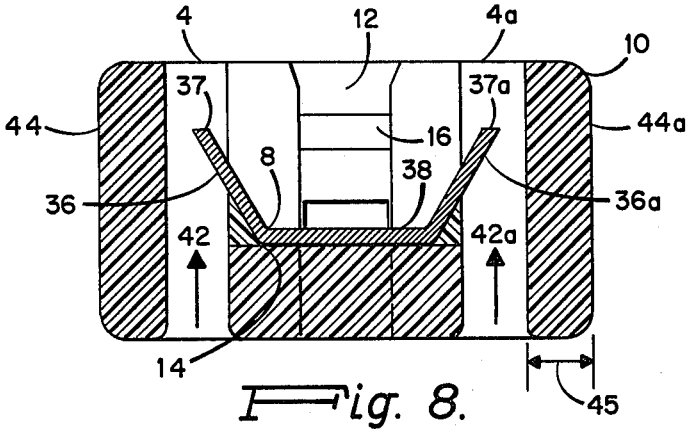
FIG. 8 is a section corresponding to FIG. 3 showing the metal anchor member in position.

The anchor member 8, (FIGS. 5, 6, and 7) is formed from a sheet of spring steel in the form of a cross with two oppositely-extending retaining ears 34 and 34*a* and two longer opposing locking ears 36 and 36*a*. As shown in FIGS. 6 and 7, the retaining ears 34 and 34*a* are bent upwardly at an angle of about 30°, and the longer locking ears 365 and 36*a* are bent upwardly to form an angle of about 35° with respect to the longitudinal axes of the passageways 4 and 4*a*. The outer end surface 37 of the locking ear 36 is cut at an angle so that the surface at the end of the ear is in a plane approximately parallel with the plane of the base section 38 of the anchor member 8 and substantially perpendicular to the longitudinal axis of the passageway 4. The outer edge 40 of the ear 36 should be sharp and free from burrs so that it can bite into the clinch the surface of the plastic strap 2. The ear 36*a* has a similar surface 37*a* and sharp edge 40*a*.

Figure 9:
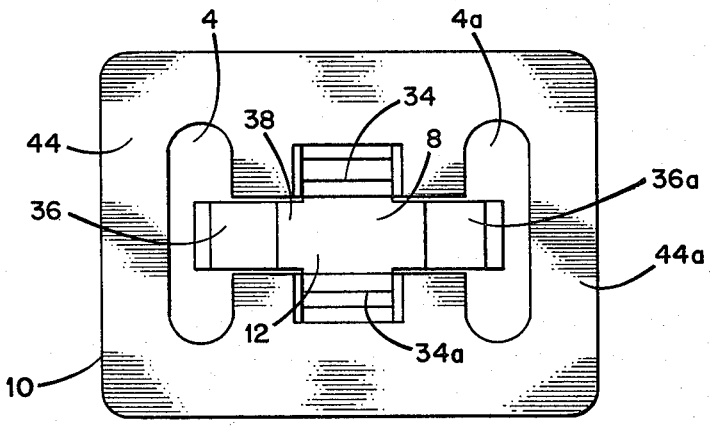
FIG. 9 is a plan view corresponding to FIG. 2 showing the metal anchor member in position.
Figure 10:
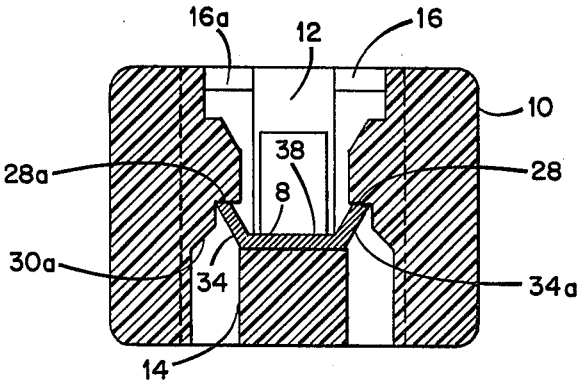
FIG. 10 is a sectional view corresponding to FIG. 4 showing the metal anchor member in position.

To assemble the fastener, the anchor member 8 is forced downwardly into the chamber 12 so that the base section 38 of the anchor member 8 rests on the floor 14. The retaining eare 34 and 34*a* flex inwardly during insertion and then spring outwardly so that the ends of the ears respectively engage the lower surfaces of the shoulders 28 and 28*a* as shown in FIG. 10. The locking ears 36 and 36*a*, which are also flexed inwardly during insertion, spring outwardly into the passageways 4 and 4*a* as shown in FIG. 9.

When one end of the strap 2 is pushed into the passageway 4 in the direction of the arrow 42 (FIG. 8), it causes the locking ear 36 to flex inwardly and permit the strap to pass. Any subsequent force on the strap 2 in the direction opposite from the arrow 42 causes the ear 36 to bite into the plastic strap and prevent it from being withdrawn. The other passageway 4*a* and the locing ear 36*a* provide a similar locking arrangement for the opposite end of the strap 2 when inserted in the direction of the arrow 42*a*.

Figure 1:
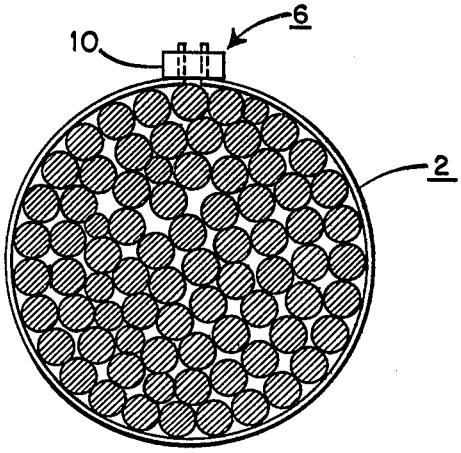
FIG. 1 is a side elevation of a fastener embodying the invention shown in use as a cable tie.

In use, the two ends of the strap 2 enter the body at the same end in the same direction, rather than from opposite directions into opposite ends of the body. The arrangement of the head with its two parallel passageways and locking arrangements, causes the strap, when wrapped around the articles to be bundled and pulled tight, to extend laterally out from the base of the body 10, as shown in FIG. 1. The force binding the articles is a tensile force in the direction of the axis of the strap so that this force is thus not applied directly to the ears 36 and 36*a*, but produces an outward force on the plastic body that is resisted by the two end sections 44 and 44*a* that form part of the body 10. By this arrangement the holding force of the fastener is materially increased over what it would be if the force were applied in a direction parallel with the longitudinal axes of the passageways 4 and 4*a*.

The holding strength of the body 10 and the tensile strength of the strap 2 are related. Preferably, the strap should have a breaking strength about equal to the holding power of the body, and the use of any heavier strap is uneconomical. In practice, I prefer that the thickness of each end section 44 and 44*a*, as indicated by the dimension 45 in FIG. 8, be at least as great as the thickness of the strap.

Figure 14:
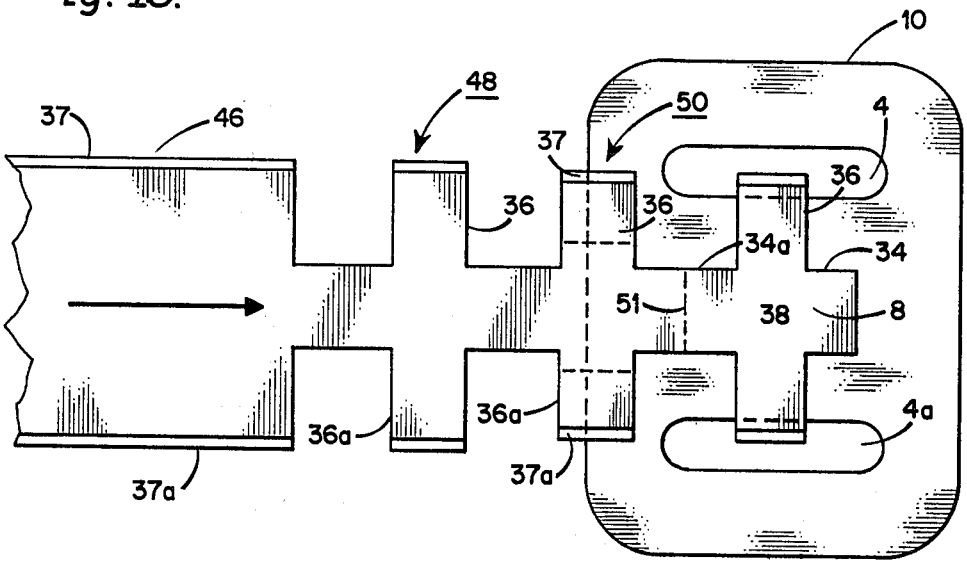
FIG. 14 illustrates the successive steps in the formation of the metal anchor member and its insertion into the body.

The fastener may be assembled on a continuous basis (FIG. 14). Prior to forming the anchor member 8, the end surfaces of the locking ears are beveled at an angle, as previously described, by rolling the edges of a continuous strip 46 of spring steel. The strip 46 is fed into a progressive die that cuts the strip into the shape generally illustrated at 48 with the locking ears 36 and 36*a* extending outwardly. The locking ears are then bent upwardly, as indicated at the area 50, at an angle of about 55° from the plane of the base section 38.

In the final stage of assembly the individual anchor member 8 is cut along the line 51 from the end of the strip 46, the retaining ears 34 and 34*a* are bent upwardly and the anchor member 8 forced downwardly into a body 10 positioned directly beneath. This body is the same as the body 10 previously described except the corners are more rounded to gain maximum strength with minimum material. A mandrel of appropriate shape is used to force the anchor member into the body and when the base 38 is seated on the floor 14, the mandrel spreads the retaining ears 34 and 34*a* outwardly so they are firmly engaged with the retaining shoulders 28 and 28*a*. This mode of construction avoids the difficult task of sorting and positioning the small anchor members from a bulk supply.

Figure 11:
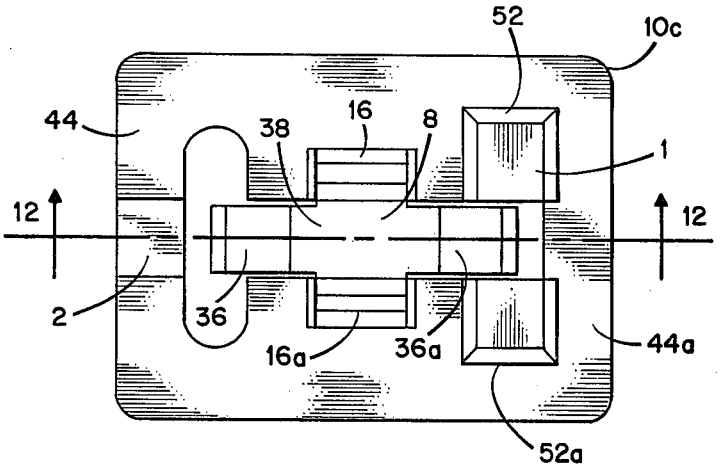
FIG. 11 is a top view of another embodiment of the fastener for permanently anchoring one end of the strap to the body.
Figure 12:
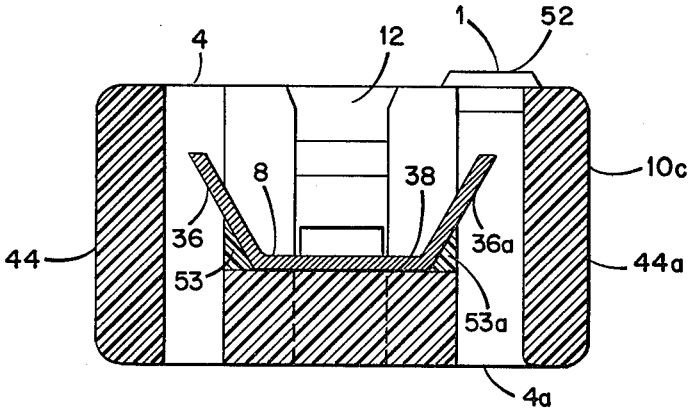
FIG. 12 is a section along line 12—12 of FIG. 11.

In another embodiment of the invention, a one-piece tie is formed by permanently anchoring one end of the strap in the fastener boby 10. This arrangement is illustrated in FIGS. 11 and 12 in which parts corresponding to those shown in other figures are indicated by the same numbers. A body 10*c*, generally similar to body 10, is provided with a pair of caps 52 and 52*a* that close the upper end of the passageway 4*a*. These caps, which are molded integrally with the body 10, are in two sections to close the side portions of the passageway 4*a* while leaving the center section open to facilitate entry of the anchor member.

One end of the tie strap 2, pre-cut to the desired length, is inserted into the passageway 4*a* until it abuts the end caps 52 and 52*a*. The locking ear 36*a* then clinches the strap as described previously. The caps 52 and 52*a* preferably are formed externally of the passageway 4*a*, rather than being in the form of inserts extending into the passageway, to allow maximum distance for the strap 2 beyond the end of the locking ear 36*a* and thus insure a firm anchor while maintaining minimum height of the body 10. In use, the front end of the strap 2 is wrapped around the objects to be bundled and inserted through the passgeway 4. This arrangement provides the advantage of a single-piece tie at the point of application, but minimizes the inventory necessary to provide tie straps of different lengths. In this embodiment, the plastic body 10*c* is formed with two reinforcing filets 53 and 53*a*, formed integrally with the floor 14, that engage the undersides of the locking ears 36 and 36*a* to provide full support to the entrance to the passageways 4 and 4*a*. Thus the ears 36 and 36*a* are capable of moving, in response to a force in the direction of withdrawal of the strap 2, only to the extent the ear can flex within the passageway. The holding strength is materially increased by this support which extends to the very edges of the passageway.

Alternative structures for securing the anchor member 8 in the body 10, such as a pin or cross bar, may be used or the anchor member may be molded into the plastic body. Separate locking ears may be substituted for the anchor member and the ears driven into the plastic in the manner of a nail. Such constructions may have advantage under some circumstances for particular applications, but for general use, I prefer the construction previously illustrated.

Figure 13:
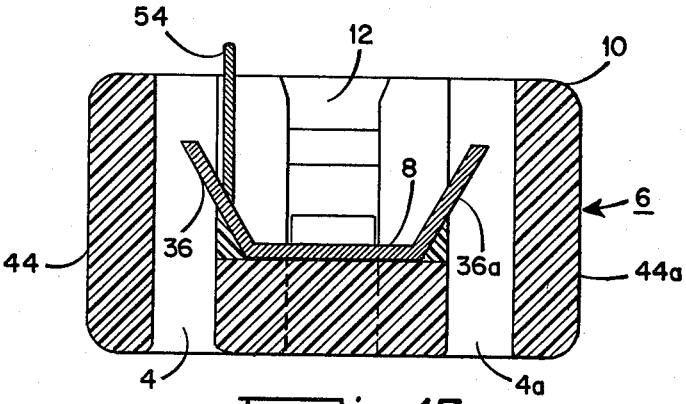
FIG. 13 is a sectional view of a fastener having means for releasing the body from the tie strap.

For some applications, it may be desirable to be able to release the fastener from the strap. FIG. 13 illustrates such a releasable fastener. This construction is the same as that illustrated by FIGS. 1–9 with the addition of a release pin 54 secured to the locking ear 36 and extending upwardly through the chamber 12 and above the top end of the body 10. After the strap 2 has been anchored by the locking ear 36, the strap may be released by pushing the pin 54 inwardly toward the center of the body 10 thus flexing the ear 36 and disengaging it from the strap 2 and permitting removal of the strap.

Figure 15:
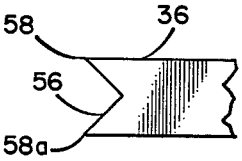
FIG. 15 is a plan view of a modified locking ear.

As stated above, it is desirable to minimize the area of the locking ears 36 and **36*a* in engagement with the strap 2 to maximize the strength of the grip. In an alternative construction, rather than beveling the ends of the ears as shown in FIG. 6, the ends of the ears may be notched or cut away, as in the shape of a vee or an arc, to provide a pair of points to make initial engagement with the strap 2. FIG. 15 shows the end of an ear 36*c* that is similar in all respects to the ear 36, except for a v-notch 56 cut in the end of the ear to form two points 58 and 58*a* that engage the strap 2. In this construction, the end of the locking ear need not be beveled and a simple cutting or stamping operation is all that is required to form the ear. The width of the v-notch 56 may, if desired, be somewhat less than the width of the ear 36*c* providing finite widths for the points 58 and 58*a***.

From the foregoing it will be seen that my invention is well adapted to attain the ends and objects herein set forth, that it is capable of economical manufacture and that the various embodiments in which it is illustrated can be modified readily in a variety of ways to best suit it to each particular application without departing from the scope of my invention.

I claim:

1. A packaging fastener for use with a flexible strap comprising a molded body having substantially parallel first and second passageways therein each defining means for receiving an end portion of said strap, bridge means formed integrally with said body and forming at least a partial separation between said passageways, an anchor member having a base portion positioned within said body and supported by said bridge means, and first and second locking ears forming an integral part of said anchor member and extending from opposite ends of said base, said ears being flexibly retained in said body and extending respectively into said first and second passageways at an acute angle with respect to the longitudinal axis of the respective passageway, whereby when said strap is inserted in a first direction into either of said passageways the respective locking ear flexes to permit passage of said strap in said first direction and engages the strap to resist movement in the opposite direction.

2. A packaging fastener for use with a flexible strap comprising a molded body having first and second passageways therein each defining means for receiving an end portion of said strap, bridge means formed integrally with said body and forming at least a partial separation between said passageways, an anchor member having a base portion positioned within said body and supported by said bridge, and first and second locking ears forming an integral part of said anchor member and extending from opposite ends of said base, said ears being flexibly retained in said body and extending respectively into said first and second passageways at an acute angle with respect to the longitudinal axis of the respective passageway, each of said locking ears having an angular and surface positioned in a plane substantially perpendicular to the longitudinal axis of the respective passageway, whereby when said strap is inserted in a first direction into either of said passageways the respective locking ear flexes to permit passage of said strap in said first direction and engages the strap to resist movement in the opposite direction.

3. A fastener as claimed in claim 1 or claim 2 wherein said body has first and second internal oppositely-disposed shoulders each having a surface area substantially perpendicular to the longitudinal axes of said passageways, and said anchor member is formed of spring steel and includes oppositely-disposed first and second retaining ears having an end surface engaging said surface area of one of said shoulders, whereby said anchor member is retained in said head.

4. A fastener as claimed in claim 3 wherein said body has a chamber having a floor and first and second side walls, said side walls extending respectively from said first and second shoulders to one outer surface of said body, the width of said chamber in one direction being less than the distance between the ends of said retaining ears when unrestricted, and wherein said base of said anchor member rests on said floor, whereby said anchor member may be inserted into said chamber with resultant flexing of said retaining ears during insertion with subsequent expansion to cause said anchor member to be retained in said head by said shoulders.

* * * * *